US006457517B1

(12) United States Patent
Goodson et al.

(10) Patent No.: US 6,457,517 B1
(45) Date of Patent: Oct. 1, 2002

(54) COMPOSITE LANDING COLLAR FOR CEMENTING OPERATION

(75) Inventors: Jim Goodson, Porter; Sidney K. Smith, Jr., Conroe; Paul Zutz, Sugar Land; Yusheng Yuan, Houston, all of TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/771,745

(22) Filed: Jan. 29, 2001

(51) Int. Cl.[7] ..... E21B 17/14; E21B 33/12

(52) U.S. Cl. ..... 166/156; 166/177.4; 166/242.8; 166/380

(58) Field of Search ..... 166/153, 156, 166/177.3, 177.4, 192, 241.6, 242.8, 242.9, 291, 380

(56) References Cited

U.S. PATENT DOCUMENTS

| | | | | | |
|---|---|---|---|---|---|
| 2,572,309 | A | * | 10/1951 | Brown | 166/121 |
| 3,420,309 | A | * | 1/1969 | Beylick | 166/235 |
| 4,510,994 | A | * | 4/1985 | Pringle | 166/156 |
| 5,165,473 | A | * | 11/1992 | Bode | 166/156 |
| 5,390,736 | A | * | 2/1995 | Budde | 166/153 |
| 5,413,172 | A | | 5/1995 | Laurel | |
| 5,842,517 | A | * | 12/1998 | Coone | 166/156 |
| 5,964,297 | A | * | 10/1999 | Edman | 166/242.8 |
| 6,056,053 | A | * | 5/2000 | Giroux et al. | 166/155 |
| 6,079,496 | A | | 6/2000 | Hirth | |
| 6,082,451 | A | * | 7/2000 | Giroux et al. | 166/153 |
| 6,237,686 | B1 | * | 5/2001 | Ryll et al. | 166/153 |

FOREIGN PATENT DOCUMENTS

| | | |
|---|---|---|
| EP | 91310578.9 | 11/1991 |
| WO | PCT/US99/23861 | 2/2001 |

OTHER PUBLICATIONS

Weatherford Cementing Products Brochure, "Float and Stage Equipment," pp. 6 and 10, Aug. 1998.

* cited by examiner

*Primary Examiner*—George Suchfield
(74) *Attorney, Agent, or Firm*—Steve Rosenblatt

(57) ABSTRACT

A composite landing collar is disclosed which is preferably adhesive bonded to the liner string using a high temperature epoxy. The spacing during bonding is maintained within dimensional limits using spacers. The body features a bi-directional material, with an appropriate ratio in the warp and fills directions, for about a quarter of the wall thickness. A unidirectional material with the fibers axially aligned aids in reduction of thermal stresses in the thick wall during curing, as well as reducing shear stress concentration along the adhesive bonding interface.

17 Claims, 1 Drawing Sheet

COMPOSITE LANDING COLLAR FOR CEMENTING OPERATION

FIELD OF THE INVENTION

The field of this invention relates to landing collars for wiper plugs used in cementing operations and more particularly to the construction thereof, using composite materials as well as the mounting technique in casing.

BACKGROUND OF THE INVENTION

Landing collars are used as an accessory inside liner casing strings for cementing operations. The landing collars must be removed at the conclusion of the cementing job, usually by drilling it out. Since drilling out takes time, prior solutions have emphasized the use of relatively soft metals such as aluminum. Aluminum still presented too much resistance to drilling out. More recently, U.S. Pat. No. 6,079,496 addressed the problem of shocking the formation when landing wiper plugs on landing collars. Although the focus of this patent was in shock reduction, it also suggested that drillability of landing collars could be improved by using non-metallic components. It further suggested use of engineering grade plastics, epoxies, or phenolics for many of the landing collar components. It further suggested use of a ceramic ball seat in combination with a non-metallic ball. This patent, which is being reissued to add claims to these features, did not detail construction techniques, which would allow bump pressure differentials of 10,000 PSI or more. It did not illustrate a mounting technique compatible with such high-pressure differentials.

One of the objectives of the present invention is to provide a landing collar that can be securely mounted in a manner which will eliminate or minimize leakage around its connection to the liner string while at the same time the landing collar possesses the structural strength to withstand bump pressures in excess of 10,000 PSI when the wiper plug lands. At the same time, the landing collar can effectively hold the wiper plug against rotation during drill out. Finally, the unique construction combines the feature of rapid drill out. Those skilled in the art will more readily understand these and other advantages of the present invention by a review of the description of the preferred embodiment, which appears below.

SUMMARY OF THE INVENTION

A composite landing collar is disclosed which is preferably adhesive bonded to the liner string using a high temperature epoxy. The spacing during bonding is maintained within dimensional limits using spacers. The body features a bi-directional material, with an appropriate ratio in the warp and fills directions, for about a quarter of the wall thickness. A unidirectional material with the fibers axially aligned aids in reduction of thermal stresses in the thick wall during curing, as well as reducing shear stress concentration along the adhesive bonding interface.

DETAILED DESCRIPTION OF THE PREFERRED EMBODIMENT

Figure 1:
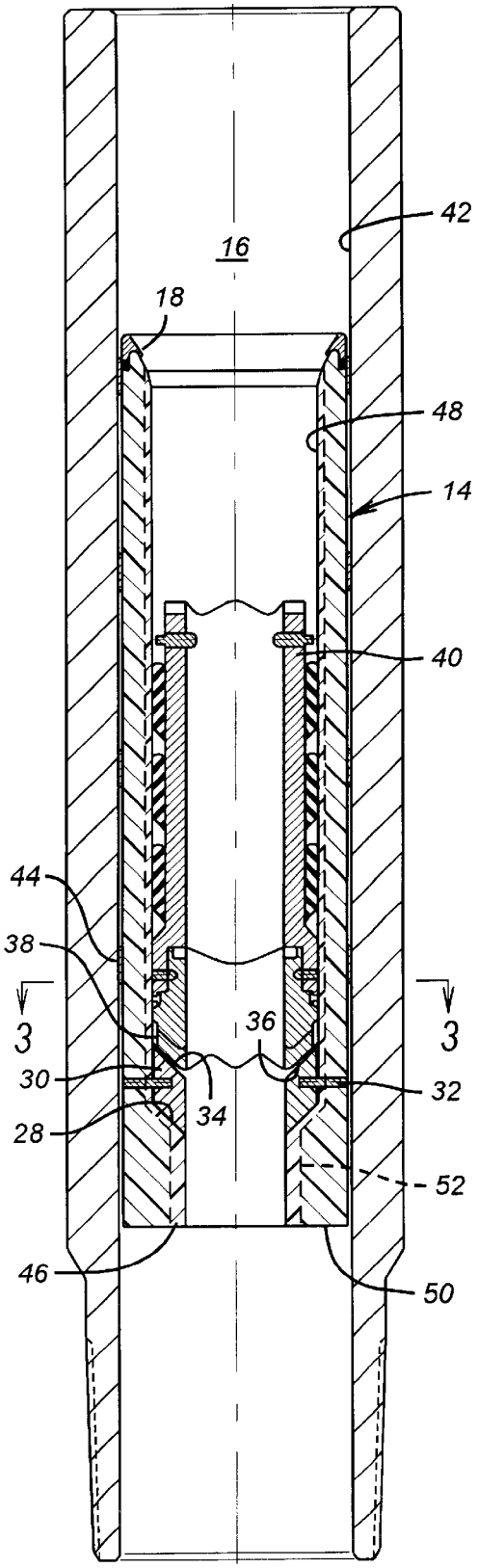
FIG. 1 is a sectional elevation view of the landing collar with a wiper plug landed.
Figure 2:
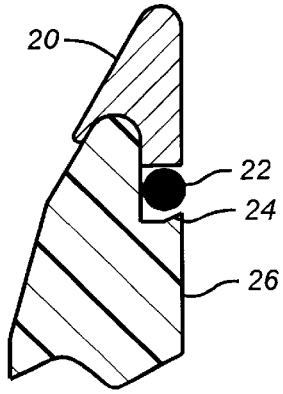
FIG. 2 is a detail of the top of FIG. 1.
Figure 3:
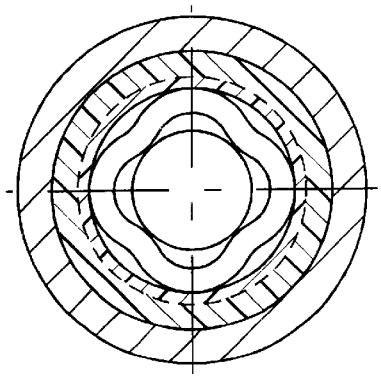
FIG. 3 is a section view along lines 3—3 of FIG. 1.

Referring to FIG. 1, the landing collar 10 is shown inside the tubular 12, which can be a liner string or casing string component. The landing collar 12 has a tubular body 14 and a central passage 16. At the upper end 18 is a back-up ring 20 which helps retain o-ring seal 22 against shoulder 24, adjacent the outer surface 26 of the body 14(see FIG. 2). Tubular body 14 further comprises a shoulder 28 on which rests ring insert 30. One or more pins 32 secure ring insert 30 to shoulder 28. Ring insert 30 has a top undulating surface 34 to mate with undulating surface 36 at the lower end 38 of wiper plug 40. Upon contact of the undulating surfaces 34 and 36 a resistance to rotation is present in the wiper plug 40 as it and the landing collar 14 are being drilled out.

The preferred mode of attachment of the outer surface 26 to the inside wall 42 is to use a high temperature epoxy-based adhesive in an annular clearance gap of about 0.010 to 0.015 inches. This clearance can be maintained using spacers 44 during the bonding process. This insures a uniform adhesive layer between the outer surface 26 and the inside wall 42. Curing can be accomplished in two steps. First, there is a low temperature initial curing using temperatures in the range of about 57–63 degrees Centigrade followed by a high temperature post cure using temperatures in the range of approximately 174–180 degrees Centigrade to reduce thermal stresses on the bonding interface when the bonded assembly is cooled from final curing temperature to room temperature.

The body 14 employs a fiber reinforced, high temperature polymer-matrix composite material due to its good mechanical performance at high temperatures. For example, loading capacities in excess of 10,000 PSI can be withstood by the bonding system between the outer surface 26 and the inside wall 42 in a 7 inch casing. Seal 22 prevents leakage between these two surfaces, which are adhesive bonded together.

The body 14 can be glass or carbon fiber reinforced with the resin system being epoxy or phenolic having a glass transition temperature above 400 F. Body 14 can be manufactured by filament winding, wrapping or laminating with a wet process, a prepreg process or a resin transfer process. It is preferred to use the resin transfer process with a dry reinforcement pre-form because it provides a consistent dense material with a satisfactory fiber concentration.

In the preferred embodiment, the body 14 comprises an internal layer of a bi-directional material such as 4985 or 6781, which has an appropriate fiber ratio in the warp, and fill direction of about 62:38 or 51:49. This material preferably comprises about a quarter of the wall thickness and is the innermost layer, which extends the length of body 14. This inner layer 46 provides sufficient tensile strength to inner surface 48 in the axial and hoop directions. Overlaying layer 46 is another layer 50, which comprises a preferably unidirectional material such as 6543 or 1543 having fibers aligned in the axial direction. Its purpose is to reduce thermal stresses created in the thick wall of body 14 during the curing process. Layer 50 also helps to reduce shear stress concentration along the bonded interface between inside wall 42 and outer surface 26 after the wiper plug 40 has landed and differential pressure is applied.

To improve the strength of shoulder 28, layer 46 is extended down to form part of that shoulder. Additionally, insert ring 30, which is preferably held in position with fiberglass pins 32, improves the anti-rotation capabilities of the landing collar 10. As previously stated, it is the insert ring 30 which has the undulating surface 34 which prevents rotation of the wiper plug 40 when its undulating surface 36 engages undulating surface 34 on insert ring 30. To further add strength in this critical area, layer 46 extends beyond and forms a portion of shoulder 28. This adds tensile strength in this key area. Additionally, fiberglass roving 52 is circumferentially wound between fabric layers in inner layer 46 and outer layer 50 adjacent shoulder 28 to give it further strength. The specification for the roving 52 is E-glass 660-A5-675. The preferred manner of application and layer thickness for the roving 52 is one layer winding about 0.010 inches thick.

Those skilled in the art will appreciate that the disclosed invention will allow for large bump pressures, in excess of 10,000 PSI while maintaining sealing integrity against the casing inside wall 42. Drill-out or mill-out time is reduced by the disclosed construction, which further includes the anti-rotation feature of mating undulating surfaces 34 and 36. These and other advantages of the invention can be determined from the claims below. The above description of the preferred embodiment is merely illustrative of the optimal way of practicing the invention and various modifications in form, size, material or placement of the components can be made within the scope of the invention defined by the claims below.

We claim:

1. A landing collar for down hole use in a tubular, comprising:

a substantially non-metallic body, further comprising a flow path there-through, said flow path further comprising a shoulder surrounding it for selective reception of an object and obstruction of the tubular;

said body secured to the tubular without threads.

2. The collar of claim 1, wherein:

said body is affixed to the tubular with adhesive.

3. The collar of claim 2, wherein:

said adhesive is a high temperature epoxy based material placed in a clearance between said body and the tubular.

4. The collar of claim 3, wherein:

said clearance is maintained by at least one spacer.

5. The collar of claim 4, wherein:

said adhesive is maintained at two different temperatures during curing; and said gap is in the order of about 0.010 to 0.015 inches.

6. The collar of claim 2, wherein:

said body further comprises an inner and an outer layer made of a fiber reinforced material, said inner layer extending beyond said shoulder to provide strength in the axial and hoop directions when an object lands on said shoulder, while said outer layer reduces thermal stresses during curing of said adhesive.

7. The collar of claim 6, wherein:

said inner layer further comprises a fiber ratio in the warp and fill directions in the range of at least 1:1; and said outer layer comprises a substantially unidirectional material having its fibers substantially longitudinally aligned on said body.

8. The collar of claim 7, wherein:

said inner and outer layers are made of an epoxy or phenolic material with a glass transition temperature of greater than 400 degrees Fahrenheit.

9. The collar of claim 8, wherein:

said inner and outer layers, in the region of said shoulder, further comprise wound roving.

10. The collar of claim 9, wherein:

said inner layer represents about a quarter of the thickness of said body;

said roving is made of fiber glass; and said inner and outer layers are made using a resin transfer process with a dry reinforcement pre-form.

11. The collar of claim 2, further comprising:

a rotation locking feature on said shoulder to engage the object in such a manner as to prevent its rotation as said body is drilled or milled out.

12. The collar of claim 11, wherein:

said rotation locking feature further comprises an undulation on said shoulder.

13. The collar of claim 11, wherein:

said rotation locking feature further comprises an insert ring supported by said shoulder and having an undulating top surface.

14. The collar of claim 3, wherein:

said insert ring is pinned to said body by at least one fiberglass pin.

15. The collar of claim 1, wherein:

said shoulder can withstand differential pressures of up to about 10,000 PSI acting on an object supported on it.

16. The collar of claim 6, wherein:

said shoulder can withstand differential pressures of up to about 10,000 PSI acting on an object supported on it.

17. The collar of claim 11, wherein:

said shoulder can withstand differential pressures of up to about 10,000 PSI acting on an object supported on it.

* * * * *